US006203338B1

(12) United States Patent
Choy

(10) Patent No.: US 6,203,338 B1
(45) Date of Patent: Mar. 20, 2001

(54) CARD EDGE CONNECTOR ASSEMBLY WITH EJECTORS FOR LINEAR INSTALLATION/EJECTION AND THE ASSOCIATED PRINTED CIRCUIT BOARD FOR USE THEREWITH

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/565,732

(22) Filed: May 5, 2000

Related U.S. Application Data

(63) Continuation-in-part of application No. 09/270,380, filed on Mar. 16, 1999, now Pat. No. 6,113,398, which is a continuation-in-part of application No. 08/858,218, filed on May 10, 1997, now Pat. No. 5,882,211, and a continuation-in-part of application No. 09/016,144, filed on Jan. 30, 1998, now Pat. No. 6,086,416.

(51) Int. Cl.[7] ..... H01R 12/00
(52) U.S. Cl. ..... 439/83
(58) Field of Search ..... 439/83, 540.1, 439/350, 351, 67

(56) References Cited

U.S. PATENT DOCUMENTS 5,297,966 * 3/1994 Brennian, Jr. et al. ..... 439/64
5,387,115 * 2/1995 Kozel et al. ..... 439/83
5,779,494 * 7/1998 Ito et al. ..... 439/326

* cited by examiner

*Primary Examiner*—Renee Luebke
*Assistant Examiner*—Briggitte R. Hammond
(74) *Attorney, Agent, or Firm*—Wei Te Chung

(57) ABSTRACT

A DIMM connection system includes a pair of non-vertical DIMM first and second connectors (10, 12) head to head positioned on a printed circuit board (100). Each of the connectors (10, 12) including an insulative housing (14) defining a central slots (16) for receiving the card therein. Two rows of pairs of contacts (18) are positioned within the housing (14) by two sides of the central slot (16) for engagement with the card. A pair of ejectors (20) are disposed at two opposite ends of the housing (14) for ejecting the inserted card. The key (24) in the slot of the first connector (10) is aligned with that of the second connector (12) in a transverse direction. The pair of contacts (18) of the first connector (10) are aligned with the corresponding pair of contacts (18) of the second connector (12) in the same transverse direction. A printed circuit board (100) is positioned under the pair of connectors (10, 12), and includes four rows of conductive pads (102) thereon corresponding to the contacts (18) of the first and the second connectors (10, 12) wherein for each set including four conductive pads (102) respectively in the four rows and aligned with one another in the same transverse direction, the first conductive pad (102) is electrically connected to the third conductive pad (102) while the second conductive pad (102) is electrically connected to the fourth conductive pad (102) so that both the connectors (10, 12) share the same circuits on the printed circuit board (100).

3 Claims, 7 Drawing Sheets

CARD EDGE CONNECTOR ASSEMBLY WITH EJECTORS FOR LINEAR INSTALLATION/EJECTION AND THE ASSOCIATED PRINTED CIRCUIT BOARD FOR USE THEREWITH

This is a continuation-in-part application of the application Ser. No. 09/270,380 filed Mar. 16, 1999, now U.S. Pat No. 6,113,398 which is a continuation-in-part application of the application Ser. No. 08/858,218 filed May 10, 1997 now U.S. Pat. No. 5,882,211, and a continuation-in-part application of the application Ser. No. 09/016,144 filed Jan. 30, 1998. now U.S. Pat. No. 6,086,416.

BACKGROUND OF THE INVENTION

1. Field of the Invention

The invention relates to the card edge connector assembly with ejectors to linearly install/eject the card thereinto/therefrom, and particularly to the interconnection system including at least a pair of opposite such card edge connectors in a head-to-head manner with a printed circuit board thereunder.

2. The Related Art

The copending parent application Ser. No. 09/016,144 filed Jan. 30, 1998, discloses a slanted conventional DIMM (Dual In-line Memory Module) type card edge connector with ejectors thereon for use with a card or memory module. Another copending parent application Ser. No. 09/270,380 filed Mar. 16, 1999, discloses a pair of so-called SO DIMM (Small Out-line Dual In-line Memory Modules) connectors arranged in a head-to-head manner.

Anyhow, the SO DIMM connector are generally used in the notebook computers, and the desktop computers still require the conventional DIMM connectors for use therewith due to the corresponding mechanical and electrical characteristic consideration. Moreover, because the contact arrangements of the conventional DIMM connector and of the SO DIMM connector are different from each other, there are still some problems requiring to be solved during setting an interconnection system including two opposite traditional DIMM connectors mounted on the corresponding printed circuit board.

Therefore, an object of the invention is to provide an interconnection system including a pair of DIMM connectors mounted on a printed circuit board in a head-to-head manner wherein such pair of DIMM connectors are of either slanted type or horizontal type while non-vertical type for lower profile consideration.

SUMMARY OF THE INVENTION

According to an aspect of the invention, a DIMM connection system includes a pair of non-vertical DIMM first and second connectors head to head positioned on a printed circuit board. Each of the connectors including an insulative housing defining a central slots for receiving the card therein. Two rows of pairs of contacts are positioned within the housing by two sides of the central slot for engagement with the card. A pair of ejectors are disposed at two opposite ends of the housing for ejecting the inserted card. The key in the slot of the first connector is aligned with that of the second connector in a transverse direction. The pair of contacts of the first connector are aligned with the corresponding pair of contacts of the second connector in the same transverse direction. A printed circuit board is positioned under the pair of connectors, and includes four rows of conductive pads thereon corresponding to the contacts of the first and the second connectors wherein for each set including four conductive pads respectively in the four rows and aligned with one another in the same transverse direction, the first conductive pad is electrically connected to the third conductive pad while the second conductive pad is electrically connected to the fourth conductive pad so that both the connectors share the same circuits on the printed circuit board.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
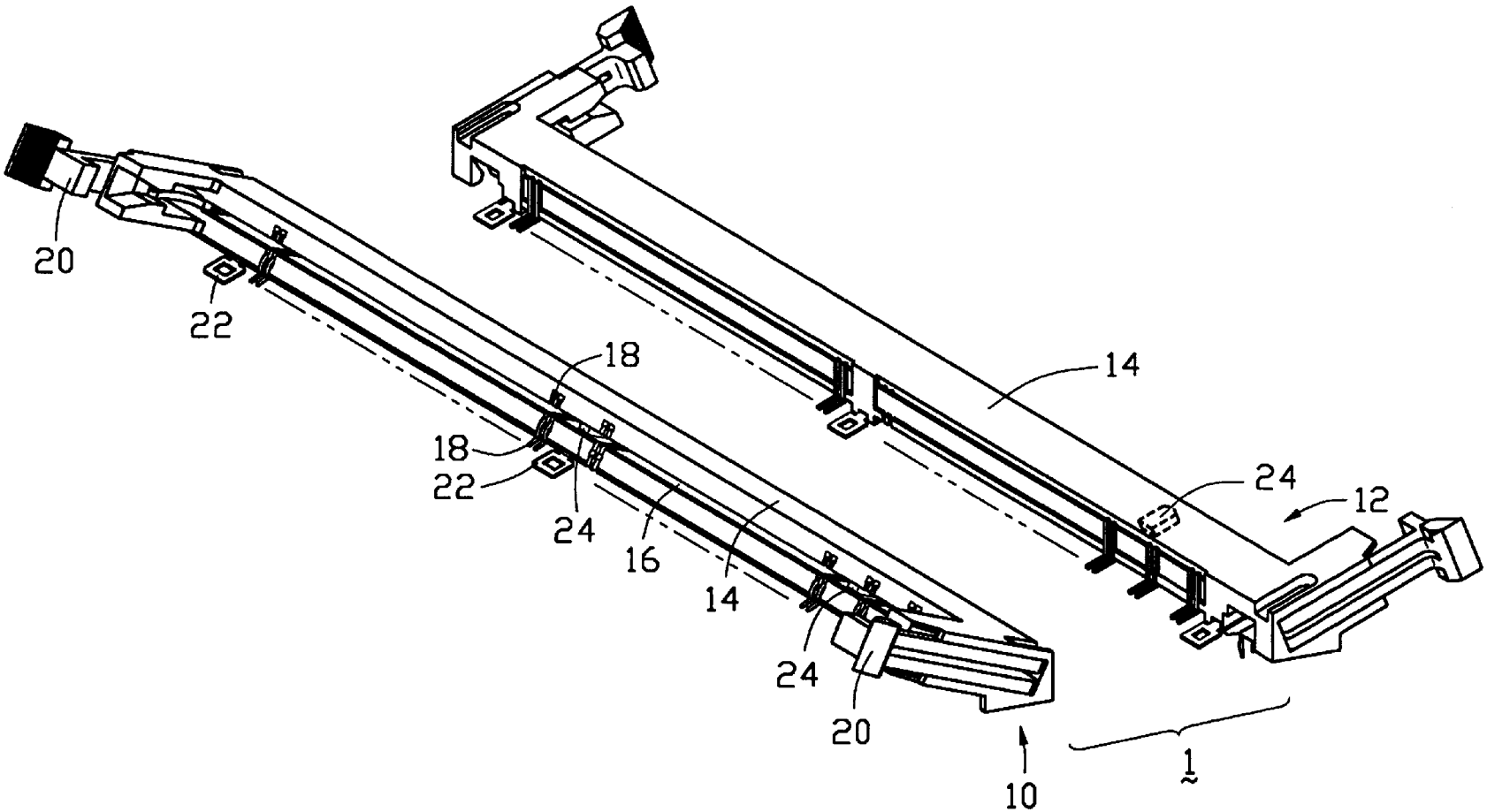
FIG. 1 is a perspective view of the presently preferred embodiment of the connector assembly according to the invention.
Figure 2:
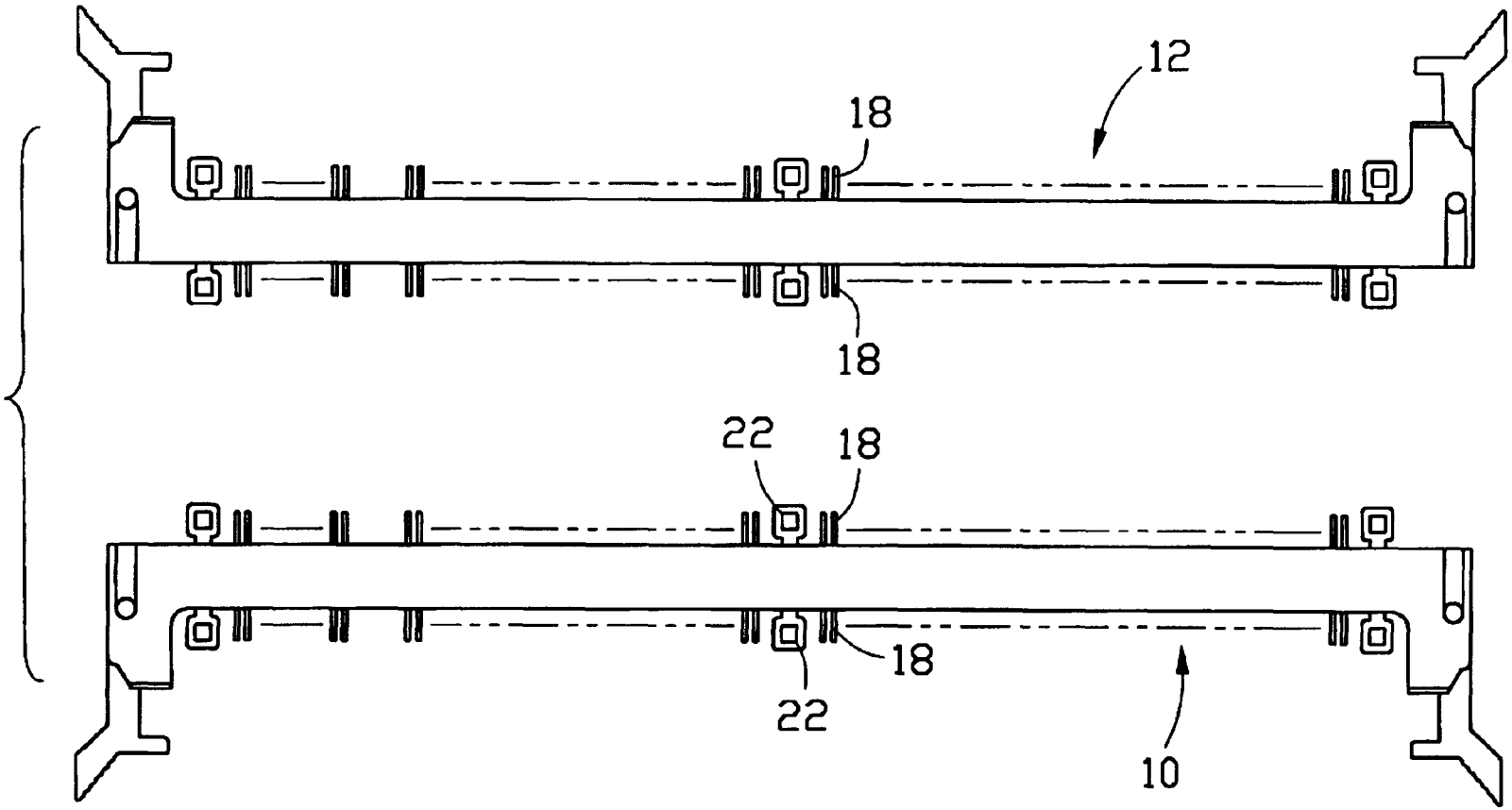
FIG. 2 is a top view of the connector assembly of FIG. 1.
Figure 3:
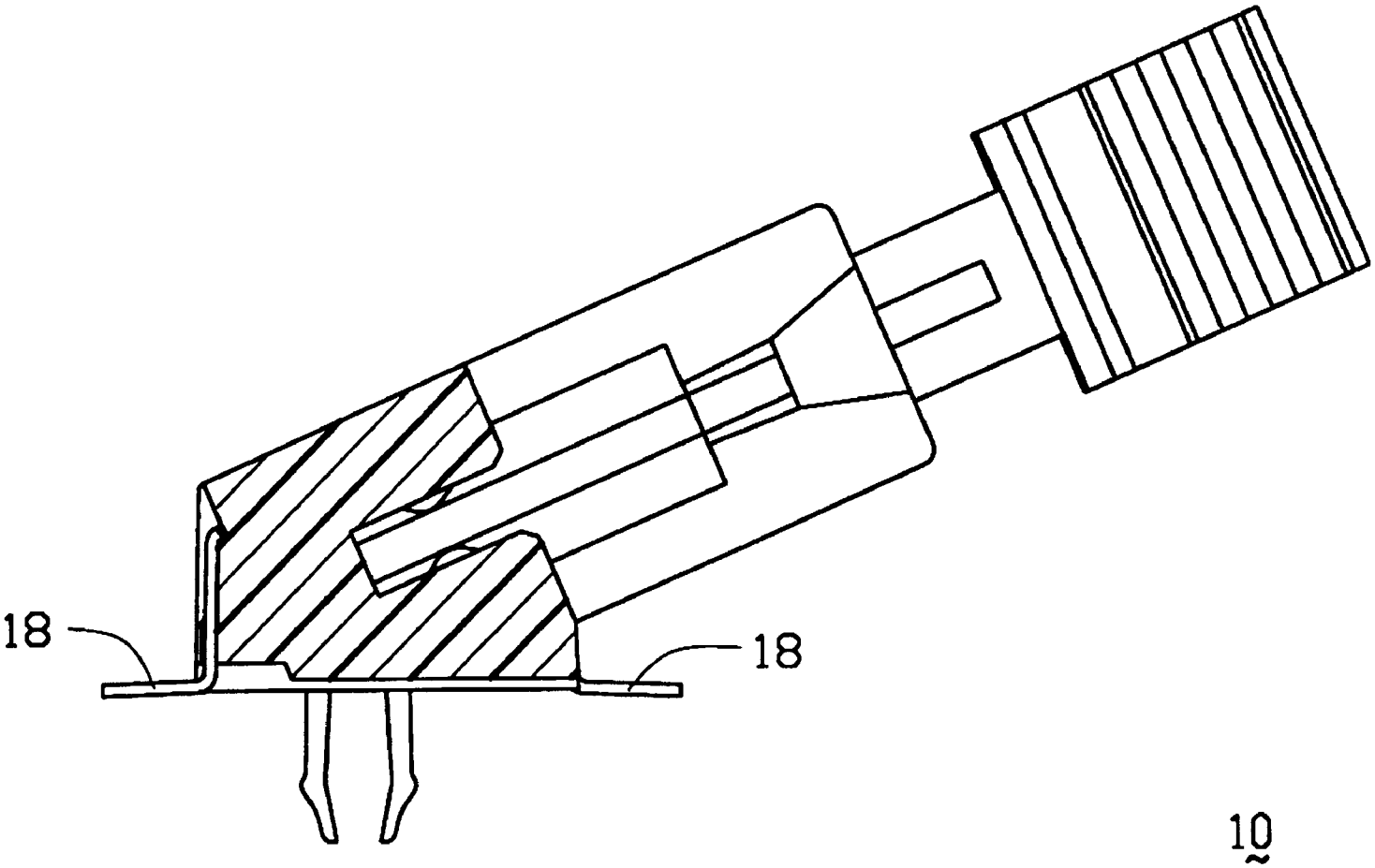
FIG. 3 is a cross-sectional view of the connector of FIG. 1.

It will be noted here that for a better understanding, most of like components are designated by like reference numerals throughout the various figures in the embodiments. Attention is directed to FIGS. 1–3 wherein a connector assembly 1 includes a first slanted connector 10 and a second slanted connector 12 head to head positioned with each other. The first connector 10 includes an insulative housing 14 defining a central slot 16 along the lengthwise direction thereof for receiving a card (i.e., memory module, not shown) therein. Two rows of contacts 18 are positioned by two sides of the slot 16 in pairs for engagement with the inserted card. A pair of ejectors 20 are disposed at two opposite ends of the housing 14 for ejecting the inserted card from the housing 14.

Similar to the contacts 18, three pairs of mounting tags 22 are positioned by two sides of the housing 14. Keys 24 are formed in the slot 16 for orientating the inserted card within the housing 14.

The second connector 12 generally has the same components with the first connector 10 including the housing 14, the central slot 16, the pairs of contacts 18, the ejectors 20, the mounting tags 22 (only one shown) and the keys 24, except that the contacts 18, the keys 24 and the mounting tags 22 are positioned relative to the housing 14 along the lengthwise direction thereof in a reverse manner. Therefore, when the first connector 10 and the second connector 12 are head to head positioned with each other, the second connector 12 is an mirror image of the first connector 10, thus both of the first connector 10 and the second connector 12 being symmetric with each other along a lengthwise center line therebetween, wherein the pairs of contacts 18 of the first connector 10 and those of the second connector 12 are respectively aligned with each other in a transverse direction, the pairs of mounting tags 22 of the first connector 10 and those of the second connector 12 are respectively aligned with each other in the same transverse direction, and the keys 24 of the first connector 10 and the those of the second connector 12 are respectively aligned with each other in the same transverse direction.

Figure 4:
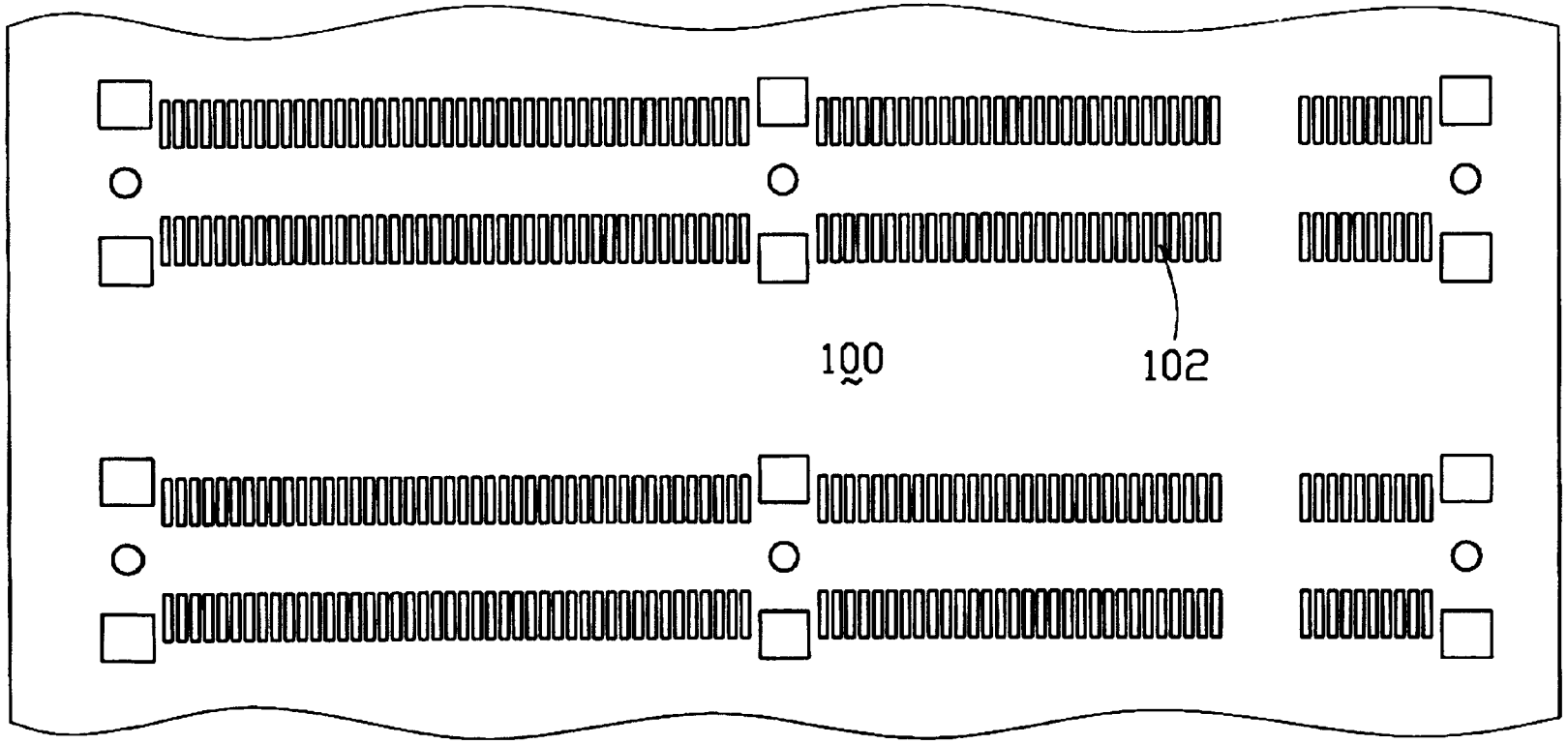
FIG. 4 is a printed circuit board for use with the connector assembly of FIG. 1 with conductive pads thereon.
Figure 5:
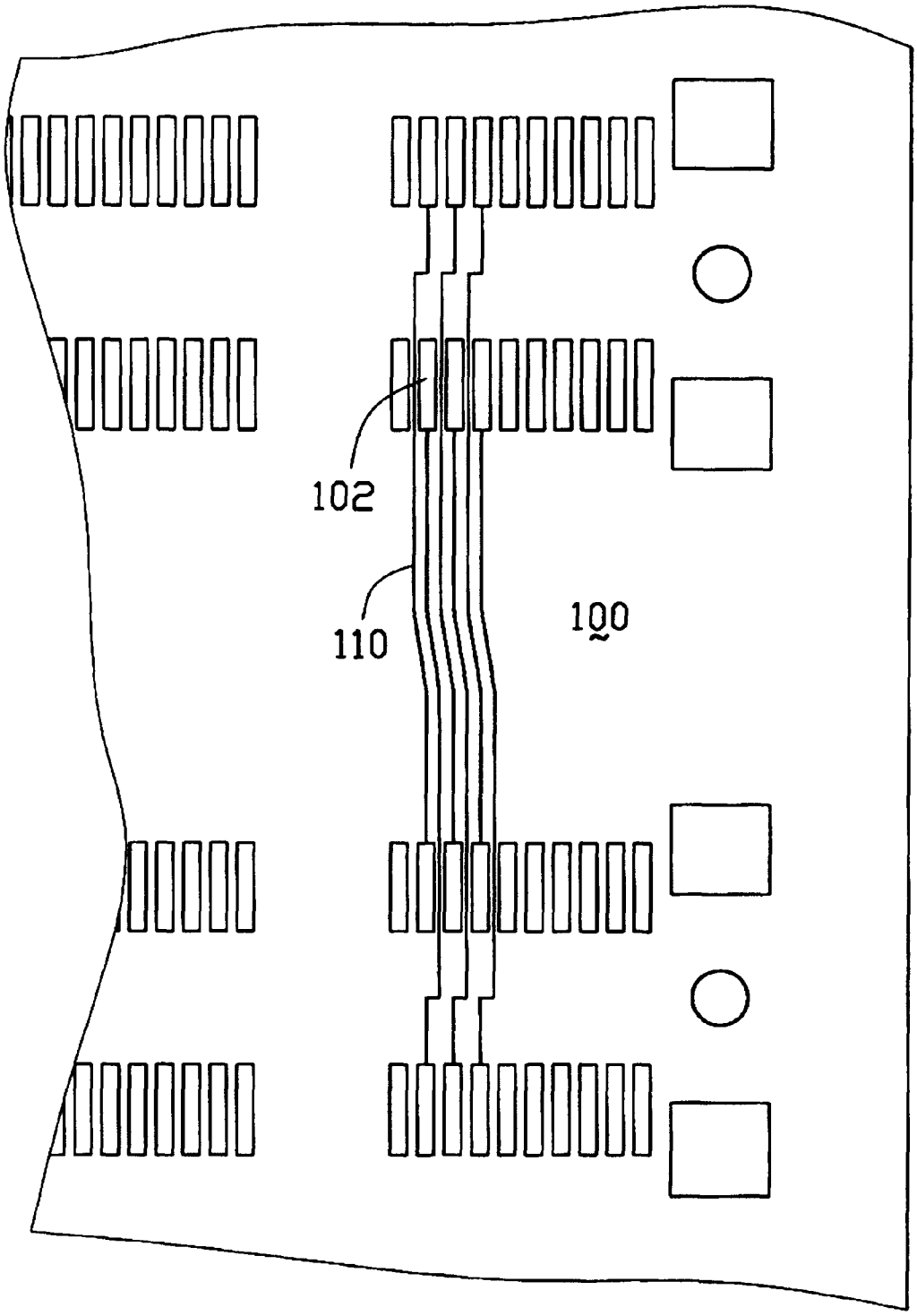
FIG. 5 is an enlarged plan view of the printed circuit board of FIG. 4 to show the conductive trances connected between the conductive pads.

Also referring to FIGS. 4 and 5, the first connector 10 and the second connector 12 are positioned on a same printed circuit board 100 on which four rows of conductive pads 102 are formed. Every four conductive pads 102 of the respective row rows are aligned with one another in a transverse direction for compliance with the corresponding contacts 18 of the first connector 10 and the second connector 12 wherein the conductive pad 102 in the first row are electrically connected to that in the third row via the conductive trace 110 and the conductive pad 102 in the second row are electrically connected to that in the fourth row via the conductive trace 110. Therefore, the first connector 10 and the second connector 12 share the same circuits on the printed circuit board 100.

In application, similar to the parent application, the card inserted into the first connector 10 should be upside-down inserted into the second connector 12. Different from the parent application which discloses different sets of the contacts used in the pair of respective connectors, the connector 10 uses two type, i.e., upper row and lower row, contacts 18 which are totally same as those in the second connector 12.

Figure 6:
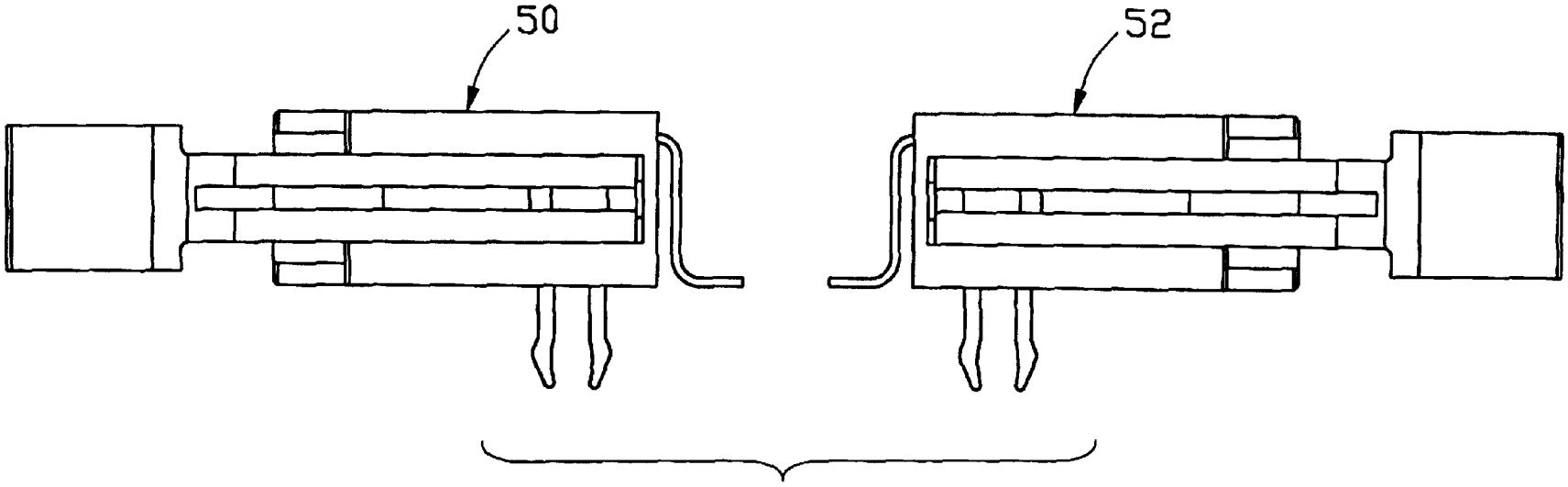
FIG. 6 is a side view of another embodiment of the connector assembly.
Figure 7:
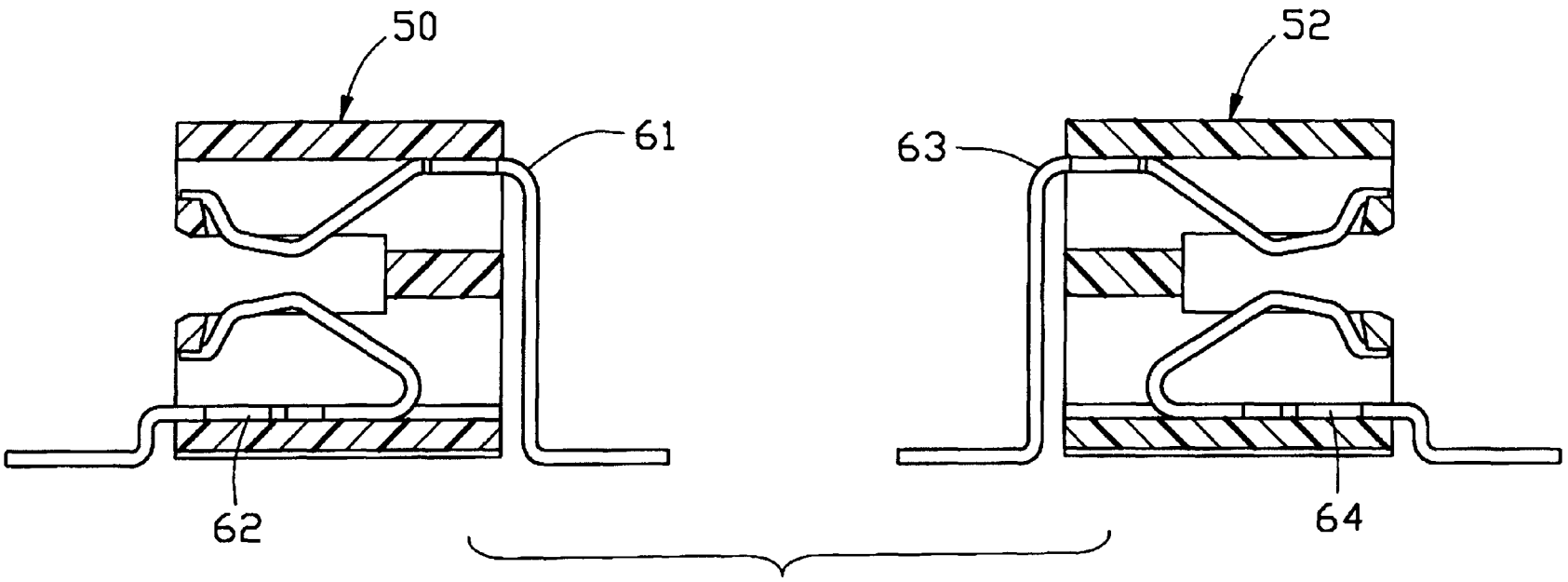
FIG. 7 is a cross-sectional view of the connector assembly of FIG. 6 to show the internal contacts therein.

FIGS. 6 and 7 show another embodiment of the invention wherein a pair of horizontal type DIMM connectors 50, 52 are head to head positioned with each other on the printed circuit board. The relation between the horizontal type DIMM connector 50 and 52 are substantially same as that of the first slanted type DIMM connector 10 and 12. In each transverse cross-section of this pair of connectors 50, 52, there are the large rear upper first contact 61 and the small front lower second contact 62 of the first connector 50, and the large rear upper third contact 63 and the small front lower fourth contact 64 of the second connector 52, wherein the first contact 61 and the third contact 63 are same with each other, the second contact 62 and the fourth contact 64 are same with each other, while the first contact 61 is electrically connected to the fourth contact 64 while the second contact 62 is electrically connected to the third contact 63.

It can be appreciated that even though in both embodiments the contacts are of the SMT (Surface Mount Technology) type, the conventional through hole type contacts are also available in this invention for reducing the distance between the two opposite connectors. While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim.

Therefore, person of ordinary skill in this field are to understand that all such equivalent structures are to be included within the scope of the following claims.

I claim:

1. An interconnection system comprising:

a first connector and a second connector head to head positioned with each other on a printed circuit board, each of said first and second connectors including:

an insulative housing defining a central slot with two rows of pairs of contacts positioned by two sides of the central slot;

four rows of conductive pads formed on the printed circuit board corresponding to two rows of the contacts of each of said connectors, respectively; wherein in every four conductive pads, taken along each transverse line, of the respective four rows of conductive pads, the conductive pad of a first row is electrically connected to the conductive pad of the third row via a trace by one side of said four conductive pads, while the conductive pad of the second row is electrically connected to the conductive pad of the fourth row via another trace on the other side of said four conductive pads.

2. The system as defined in claim 1, wherein the conductive pad of the first row is electrically connected to a lower contact of the first connector, the conductive pad of the second row is electrically connected to an upper contact of the first connector, the conductive pad of the third row is electrically connected to an upper contact of the second connector, and the conductive pad of the fourth row is electrically connected to a lower contact of the second connector.

3. The system as defined in claim 2, wherein said upper contact and said lower contact of the first connector, and said upper contact and said lower contact of the second connector are all located in a same transverse plane.

* * * * *